US005080172A

United States Patent [19]

Jones

[11] Patent Number: 5,080,172

[45] Date of Patent: Jan. 14, 1992

[54] METHOD OF RECOVERING OIL USING CONTINUOUS STEAM FLOOD FROM A SINGLE VERTICAL WELLBORE

[75] Inventor: Lloyd G. Jones, Dallas, Tex.

[73] Assignee: Mobil Oil Corporation, Fairfax, Va.

[21] Appl. No.: 605,196

[22] Filed: Oct. 29, 1990

[51] Int. Cl.[5] ..... E21B 36/00; E21B 43/24

[52] U.S. Cl. ..... 166/303; 166/306

[58] Field of Search ..... 166/303, 306

[56] References Cited

U.S. PATENT DOCUMENTS

| | | | |
|---|---|---|---|
| 2,881,838 | 4/1959 | Morse et al. | 166/303 |
| 3,126,961 | 3/1964 | Craig, Jr. et al. | 166/303 |
| 4,109,722 | 8/1978 | Widmyer et al. | 166/303 |
| 4,109,723 | 8/1978 | Widmyer | 166/303 |
| 4,480,695 | 11/1984 | Anderson | 166/303 |

*Primary Examiner*—Bruce M. Kisliuk

*Attorney, Agent, or Firm*—Alexander J. McKillop; Charles J. Speciale; Lawrence O. Miller

[57] ABSTRACT

A method for recovery of oil from a subterranean, viscous oil-containing formation penetrated by one or more wells each of which is provided with at least one separate flow paths, the first flow path in fluid communication with the bottom of the formation from adjacent or below the formation and the second flow path in fluid communication with substantially the full vertical thickness of the formation. Steam is injected into the formation via the second flow path and fluids including oils are recovered from adjacent or below the bottom of the formation via the first flow path at a predetermined rate which is substantially less than the injection rate of steam so as to increase the formation pressure to a desired level. Formation pressure is maintained at the desired level while continuing injection of steam and production of fluids including oil until the fluids recovered contain an unfavorable amount of water. In a preferred embodiment, the tubing providing the first flow path may be progressively withdrawn or lowered into the wellbore to obtain improved steam-oil ratios and/or higher oil production rates. This method provides maximum gravity drive displacement of oil from the formation.

8 Claims, 1 Drawing Sheet

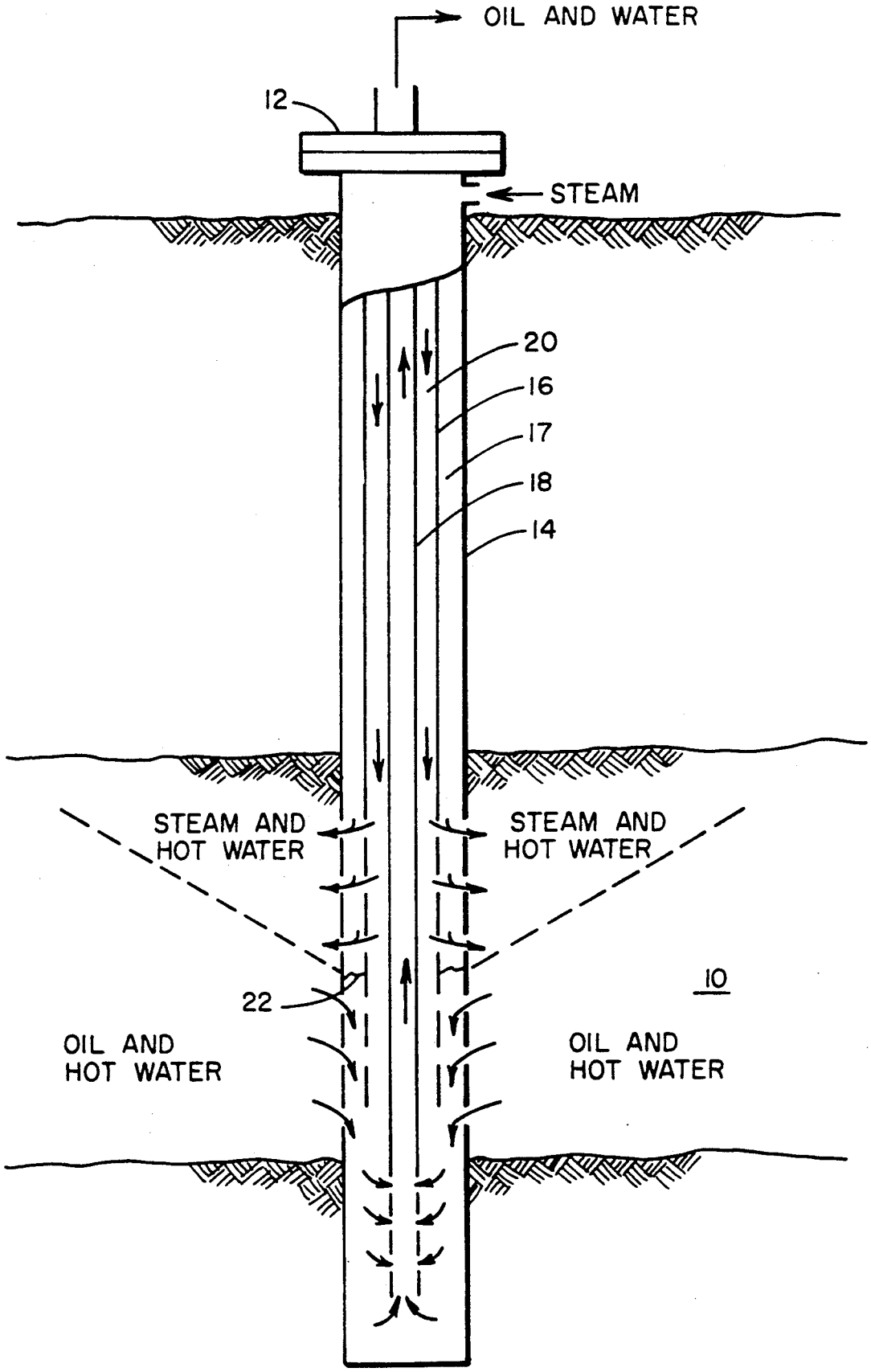
OIL AND WATER
12
STEAM
20
16
17
18
14
STEAM AND
HOT WATER
STEAM AND
HOT WATER
10
22
OIL AND
HOT WATER
OIL AND
HOT WATER

METHOD OF RECOVERING OIL USING CONTINUOUS STEAM FLOOD FROM A SINGLE VERTICAL WELLBORE

FIELD OF THE INVENTION

The present invention relates to an improved steam flood method of recovering oil from a subterranean viscous oil-containing formation using a single wellbore with a completion technique that provides maximum gravity drive displacement of the oil.

BACKGROUND OF THE INVENTION

Steam has been used in many different methods for the recovery of oil from subterranean, viscous oil-containing formations. The two most basic processes using steam for the recovery of oil includes a "steam drive" process and a "huff and puff" steam process. Steam drive involves injecting steam through an injection well into a formation. Upon entering the formation, the heat transferred to the formation by the steam lowers the viscosity of the formation oil, thereby improving its mobility. In addition, the continued injection of the steam provides the drive to displace the oil toward a production well from which it is produced. Huff and puff involves injecting steam into a formation through an injection well, stopping the injection of steam, permitting the formation to soak and then back producing oil through the original injection well.

U.S. Pat. No. 4,109,722 to Widnyer et al, discloses a method for injecting steam into a subterranean viscous oil-containing formation by a single well push-pull method in which steam injection and oil production occurs in the same well using a pressure pulsing technique to stimulate production at greater distances in the formation. In Widnyer et al, one well is drilled through the entire viscous oil formation and completed so as to establish two separate communication paths between the surface of the earth and the lower and upper portion of the formation. Initially, steam is injected into the lower and upper portion of the formation via both flow paths for a period of time followed by a soak period if desired followed by production of heated oil from both parts of the formation. Thereafter, steam is injected into either the upper or lower portion of the formation, and oil is produced from the other portion. The injection-production sequences are then reversed.

One of the problems associated with steam assisted oil recovery is that if steam stimulation is used, production is discontinued during the injection phase and if steam flooding is used, obtaining and maintaining a warm producing well can be difficult. I have found a means of combining steam stimulation with steam flooding using a single wellbore that enhances oil recovery by maximum gravity drive displacement of the oil.

SUMMARY

A method for the recovering of oil from a subterranean, viscous oil-containing formation comprising, penetrating the formation with at least one well; providing a borehole casing through said well in fluid communication with the full vertical thickness of the formation; positioning a first tubing coaxially inside said casing forming a first annulus between said casing and said tubing, said tubing extending to or adjacent the bottom of the formation and in fluid communication with said annulus; positioning a second tubing coaxially inside said first tubing forming a second annulus between said first tubing and said second tubing, said second tubing extending adjacent or below the bottom of the formation and in fluid communication with the bottom of the formation; injecting steam into the formation via the second annulus between the first and second tubing for a predetermined period of time; simultaneously recovering fluids including oil from adjacent or below the bottom of the formation via the second tubing at a predetermined rate which is substantially less than the injection rate of step (e) so as to build up the formation pressure to a desired pressure level; maintaining the formation pressure at the desired level of step (f) by continuing injection of steam and producing fluids including oil from the formation until the fluids recovered contain an unfavorable amount of water.

BRIEF DESCRIPTION OF THE DRAWING

The attached FIGURE illustrates an embodiment of the process of the invention employing a well penetrating a subterranean viscous oil-containing formation with an injection tubing positioned coaxially inside the casing extending to or adjacent the bottom of the formation and a production tubing coaxially inside the injection tubing extending adjacent or below the bottom of the formation with the annular space between the injection tubing and production tubing being utilized for injection of steam into substantially the full vertical thickness of the formation and the production tubing being utilized for production of oil and water from adjacent or below the formation.

DESCRIPTION OF THE PREFERRED EMBODIMENTS

The process of my invention may be best understood by referring to the attached drawing in which FIG. 1 illustrates a relatively thick subterranean, viscous oil-containing formation 10 penetrated by well 12. The well 12 has a casing 14 set below the oil-containing formation 10 and in fluid communication with the full vertical thickness of the formation 10 by means of perforations. Injection tubing 16 is positioned coaxially inside the casing 14 forming an annular space 17. Injection tubing 16 extends near the bottom of the formation 10 and is in fluid communication with that portion of the annulus 17 adjacent to the full vertical thickness of the formation by means of perforations as shown in FIG. 1 or is in fluid communication with the lower portion of the annulus 17 by an opening at its lower end. Production tubing 18 passes downwardly through injection tubing 18 forming an annular space 20 between injection tubing 16 and production tubing 18. Production tubing 18 extends to a point adjacent the bottom, i.e., at the bottom or slightly above or below the bottom, or below the bottom of the oil-containing formation 10, preferably 10 feet or less, and may be perforated in the lower portion to establish fluid flow communication with the lower portion of the formation 10 as shown in FIG. 1. Production tubing 18 is axially aligned inside injection tubing 16. In another embodiment the lower end of tubing may simply be open to establish fluid communication with the lower portion of the formation 10. Production tubing 18 can be fixed in the wellbore or preferably provided with means to progressively withdraw or lower the production tubing inside the wellbore to obtain improved steam-oil ratios and/or higher oil production rates. If desirable, the well casing 14 is insulated to about the top of the oil-containing formation 10 to minimize heat losses.

In the first phase of my method, steam is injected into the oil-containing formation 10 via the annular space 20 between injection tubing 16 and production tubing 18 until the oil-containing formation 10 around the casing 14 becomes warm and the pressure in the formation is raised to a predetermined value. The injected steam releases heat (Btu) to the formation and the oil resulting in a reduction in the viscosity of the oil and facilitating its flow by gravitational forces toward the bottom of the formation where it is recovered along with condensation water via production tubing 18. As steam is injected into the formation, after it releases sufficient heat (Btu) and condenses to water it thereby forms a gas/liquid interface 22 that may rise as additional steam is injected into the formation. During injection of the steam, production of fluids from below the formation 10 via the production tubing 18 is restricted with only a trickle of hot water produced at first to obtain warming along the casing 14 and thereafter increasing production flow rate as the ratio of oil to water increases in the produced fluids. Production flow rate restriction may be accomplished by use of a choke or a partially closed throttling valve. The preferred production rate is restricted to a value sufficient to maintain the pressure adjacent the bottom of the production tubing 18 to a value above the pressure at which steam is being injected into the formation. Back pressure is maintained on the well 12 at all times to assure minimal steam bypassing in the wellbore. As the pressure in the formation increases, up to a safe value which may be determined by the known maximum safe pressure at which fluid may be injected into the formation 10 without fracturing the formation or overburden above the oil saturated interval, the ratio of oil to water in the fluids produced will increase dramatically and the oil and water production can be balanced at an optimal level with steam injection rate. The pressure of the formation is maintained at the desired level while continuing injection of steam and production of fluids, until the fluids recovered contain an unfavorable amount of water. The completion technique in the present invention utilizes 3 strings, a casing 14, an injection tubing 16 and a production tubing 18 which enables steam to be injected into substantially the full vertical thickness of the formation and production of oil from adjacent or below the formation via production tubing 18. This completion enhances recovery of the heated oil by providing maximum gravity drive displacement of oil from the formation 10. In a preferred embodiment, the production tubing 18 is progressively withdrawn or lowered inside the wellbore to allow production from the maximum fraction of the oil-containing formation and to obtain improved steam-oil ratios and/or higher oil production rates.

What is claimed is:

1. A method for the recovering of oil from a subterranean, viscous oil-containing formation comprising:

(a) penetrating the formation with at least one well;

(b) providing a borehole casing through said well in fluid communication with the full vertical thickness of the formation;

(c) positioning a first tubing coaxially inside said casing forming a first annulus between said casing and said tubing, said tubing extending to or adjacent the bottom of the formation and in fluid communication with said annulus;

(d) positioning a second tubing coaxially inside said first tubing forming a second annulus between said first tubing and said second tubing, said second tubing extending adjacent or below the bottom of the formation and in fluid communication with the bottom of the formation;

(e) injecting stream into the formation via the second annulus between the first and second tubing for a predetermined period of time;

(f) simultaneously recovering fluids including oil from adjacent or below the bottom of the formation via the second tubing at a predetermined rate which is substantially less than the injection rate of step (e) so as to create a back pressure in the second tubing to minimize steam bypassing into the second tubing and to build up the formation pressure to a desired pressure level;

(g) maintaining the formation pressure at the desired level off step (f) by continuing injection of steam and producing fluids including oil from the formation until the fluids recovered contain an unfavorable amount of water.

2. A method as recited in claim 1 wherein the flow of fluid from the formation in step (f) is restricted to maintain the pressure adjacent the bottom of the second tubing to a value above the pressure at which steam is being injected into the formation.

3. A method as recited in claim 1 wherein the formation pressure is built up and maintained during step (f) at a pressure below the overburden pressure.

4. A method as recited in claim 1 wherein the second tubing is progressively withdrawn or lowered to allow production from the maximum fraction of the formation and obtain improved steam-oil ratios and/or higher oil production rates.

5. A method as recited in claim 1 wherein the first tubing is in fluid communication with the bottom of the first annulus.

6. A method as recited in claim 1 wherein the first tubing is in fluid communication with the first annulus over that portion of the annulus adjacent the full vertical thickness of the formation.

7. A method as recited in claim 1 wherein the second tubing is open at its lower end.

8. A method as recited in claim 1 wherein the second tubing is in fluid communication with the bottom of the formation from a distance of about 10 feet below the formation.

* * * * *